United States Patent [19]

Fanslow

[11] 4,373,651

[45] Feb. 15, 1983

[54] METHOD AND APPARATUS ASSEMBLING AND NAILING BOARDS TOGETHER

[76] Inventor: Charles E. Fanslow, 3371 S. Service Dr., Red Wing, Minn. 55066

[21] Appl. No.: 183,212

[22] Filed: Sep. 2, 1980

[51] Int. Cl.[3] ..... B27F 7/02

[52] U.S. Cl. ..... 227/3; 29/429; 29/432; 29/799; 227/45; 227/103

[58] Field of Search ..... 227/1, 3, 4, 45, 48, 227/100, 101, 103; 29/429, 432, 799

[56] References Cited

U.S. PATENT DOCUMENTS

| | | | |
|---|---|---|---|
| 2,649,582 | 8/1953 | Paxton | 227/48 |
| 3,591,067 | 7/1971 | Vial | 227/100 X |
| 3,706,408 | 12/1972 | Burch | 227/45 |
| 3,804,316 | 4/1974 | Kay | 227/99 X |
| 3,844,466 | 10/1974 | Narita et al. | 227/40 |
| 3,945,549 | 3/1976 | Colson | 227/45 |
| 4,204,624 | 5/1980 | Gunn et al. | 227/45 |

*Primary Examiner*—Howard N. Goldberg
*Assistant Examiner*—Fred A. Silverberg
*Attorney, Agent, or Firm*—John W. Adams

[57] ABSTRACT

A board nailing machine, herein disclosed in the form of a pallet maker, in which the stringer or inner boards are automatically fed in spaced apart relation into a nailing station and the deck boards or outer boards are automatically fed into nailing position at said nailing station on opposite sides of the stringers and thereafter the deck boards are nailed to the stringers at said nailing station. In the specific embodiment disclosed the stringers are automatically fed from supply magazines into a nailing station wherein they are disposed in horizontal parallel spaced apart relation and the deck boards are automatically fed from supply magazine into said nailing station on opposite sides of the stringers and are disposed in upstanding substantially vertical nailing position at said nailing station, and the nailing mechanism is specifically designed to drive the nails horizontally through the deck boards into the stringers at said nailing station. Adjusting mechanisms are provided for varying the spaced relation between the stringers, the deck boards, and for varying the number of deck boards supplied, and to accommodate stringers and deck boards having varying dimensions. A method for assembling and nailing boards together also is embodied in this invention and includes the steps of automatically feeding in a programmed sequence inner boards into a nailing station and outer boards together. Also embodied in the method is maintaining the assembly of boards in upstanding substantially vertical position during the assembling and nailing steps of the method.

30 Claims, 14 Drawing Figures

FIG. 12A
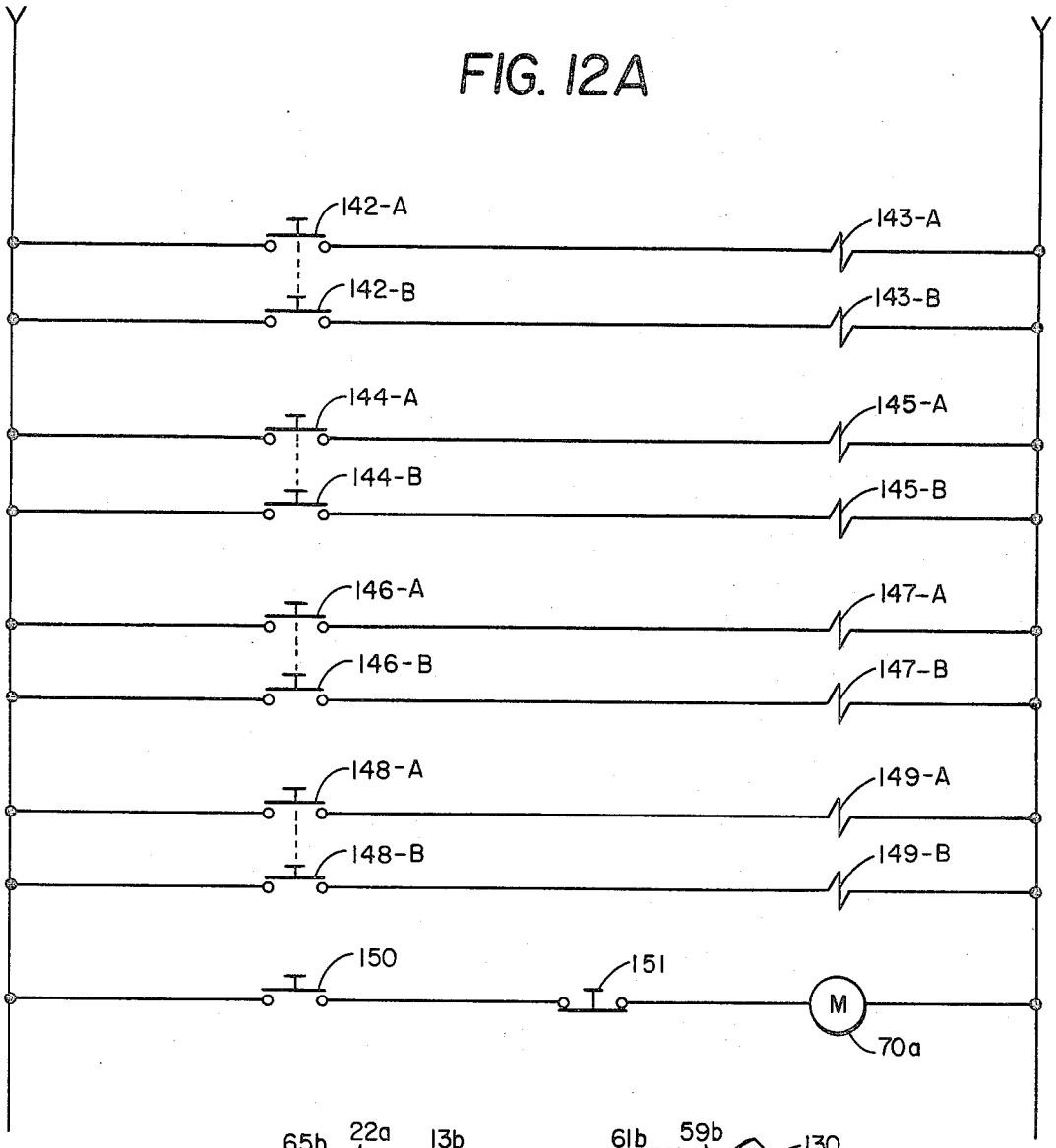
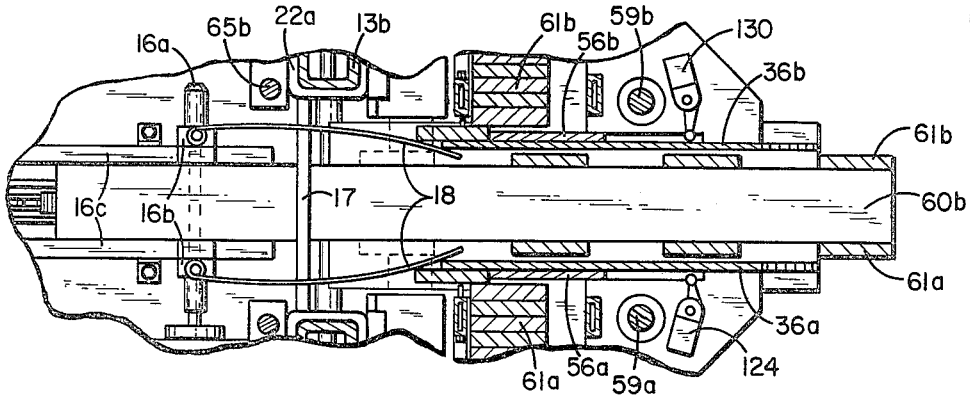
FIG. 13

METHOD AND APPARATUS ASSEMBLING AND NAILING BOARDS TOGETHER

BACKGROUND OF THE INVENTION

In the past pallet making devices have been extremely complicated and expensive machines to manufacture. The stringers are usually manually placed in horizontal position on an assembling platform and the deck boards for one side of the pallet are placed in the desired position on top of the stringers. Those deck boards are then nailed to that side of the stringers and the partially assembled pallet unit is then turned over and conveyed to a second location where the process is repeated for the deck boards on the opposite side of the stringers.

Also U.S. Pat. No. 3,844,466, issued Oct. 29, 1974 to Narita, et al, discloses an upstanding track-mounted jig onto which the stringers and deck boards are manually loaded and the jig is then manually moved on its track (while on edge in upstanding position) into a nailing machine which simultaneously nails all the deck boards to all of the stringers, and thereafter the jig with the completed pallet is moved on the track back into a transfer position from which it is transferred onto a stack of completed pallets and the jig is then manually moved back into loading position and the process repeated.

None of the prior art known to the present inventor includes any pallet maker which automatically feeds and then nails the top and bottom boards to the stringers without requiring the partially assembled pallet to be turned over to complete the operation. This obviously permits the manufacturing operation to be carried out much more rapidly and the output of the machine to be greatly increased while keeping the cost of the machine to a minimum.

SUMMARY OF THE INVENTION

The automatic pallet maker disclosed herein which embodies the present invention includes automatically activated conveyor mechanisms for simultaneously feeding the stringers into a nailing station while in aligned spaced apart relation. A deck board feeding device automatically delivers selectively programmed deck boards into nailing position at the nailing station on opposite sides of the positioned stringers where automatic nailing apparatus nails the deck boards (or slats) to the stringers and simultaneously nails the top and bottom deck boards when the same are programmed to be positioned in opposed relationship on opposite sides of the stringers at said nailing station. The nails are fed automatically from a hopper into a driving slot which permits the nail-driving member to automatically drive the nails through the slats into the stringers.

More specifically the stringers are automatically transferred to nailing position while horizontal vertically spaced apart relation and the deck boards are automatically fed into nailing position on opposite sides of the stringers while in upstanding horizontally spaced apart relation, and thereafter the deck boards are nailed to the stringers to form a nailed together pallet disposed in upstanding position.

The automatic feeding of the stringers, deck boards and nails into predetermined relationships at the nailing station in a programmed sequence is an important feature of the invention.

Also the simultaneous nailing of at least a pair of deck boards positioned at said nailing station on opposite sides of the stringers materially increases the production speed of the machine and reduces the handling of the assembled boards during the production operation as well as reducing the cost of manufacture of the machine.

DESCRIPTION OF DRAWINGS

FIG. 12A is a wiring diagram for the adjusting mechanisms; and

FIG. 13 is a fragmentary horizontal sectional view taken substantially along the line 13—13 of FIG. 5.

DESCRIPTION OF THE PREFERRED EMBODIMENT

Figure 1:
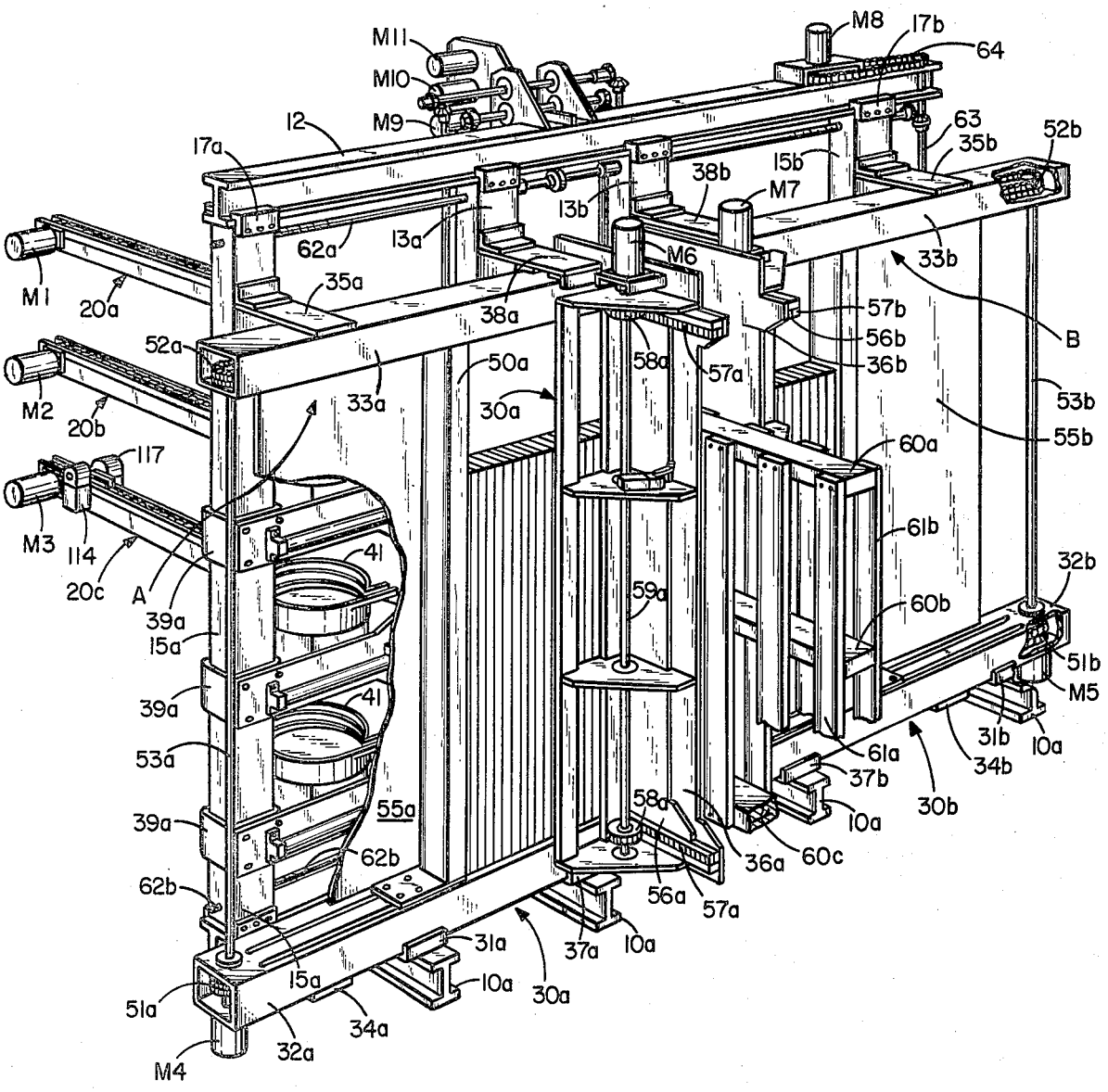
FIG. 1 is a front perspective view of a board assembling and nailing machine embodying this invention.

A board nailing machine in the form of a pallet maker embodying this invention is disclosed herein. It is understood, however, that the invention is adapted for use with other types of nailing operations. The pallet maker shown in the drawings embodies a base 10 formed from longitudinal base members **10*a* and a transverse base member 10*b*. The transverse base member 10*b* forms a bottom slide support for two sliding frame structures, respectively designated by the letters A and B. The frame structure A has an upright frame member 15*a* which is slideably mounted at its lower end on the transverse base member 10*b* and at its upper end on an upper supporting frame member 12. The frame member 12 is rigidly connected to the base member 10*b* by a pair of rigid columns 13*a* and 13*b*. The frame structure B has an upright frame member 15*b* slideably mounted at its lower end on transverse base member 10*b* and at its upper end on the upper supporting frame member 12**.

Figure 2:
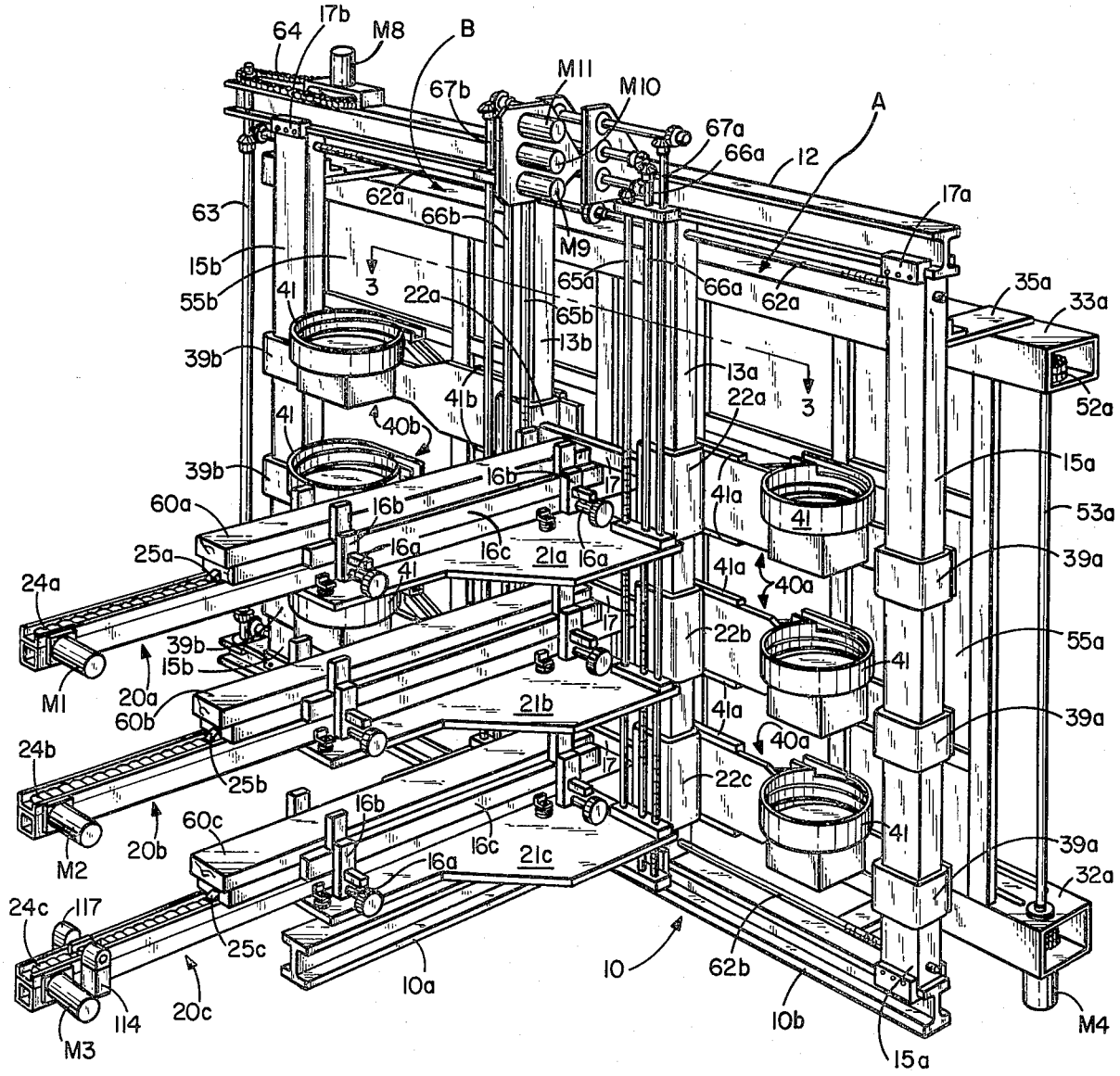
FIG. 2 is a rear perspective view thereof.

As best shown in FIG. 2, three stringer conveyor mechanisms are provided and are respectively identified by the numerals **20*a*, 20*b*, and 20*c*. All of these conveyor mechanisms are generally similar to each other. Each of these conveyor mechanisms has a stringer storage rack disposed thereabove as best shown in FIG. 2. Each storage rack includes two pairs of transversely opposed mounting struts or elements 16b. Each opposed pair of struts is carried by adjusting screws 16a and the threads of said screws are pitched in opposite directions with respect to their connection with the opposed mounting elements 16b so that rotation of the shafts 16a will adjust the spacing between said struts 16b. The struts 16b on the same side of each conveyor are connected by stringer guide rails 16c which maintain the alignment of the stringers with the nailing station S. Stop bars 17 spaced above the conveyors 20a through 20c permit the lower stringer in the stack to be removed from the stack when the conveyors are actuated as will be described hereafter. The conveyor mechanism 20a is mounted on a suitable mounting plate 21a which is fixed to a pair of sleeves 22a which are respectively mounted for vertical sliding movement on the rigid upright frame members 13a and 13b as best shown in FIG. 2. The other two conveyor mechanisms 20b and 20c are respectively mounted on mounting plates 21b and 21c which are in turn carried by guiding sleeves 22b and 22c slideably mounted on the fixed upright post or column members 13a and 13b. In the form shown, each of the conveyor mechanisms includes a chain and sprocket drive respectively designated by the characters 24a, 24b and 24c. The conveyor chains have upstanding stringer engaging lugs 25a**, *b*, and *c* respectively mounted thereon.

As best shown in FIG. 1, a pair of deck board storing and feeding magazines 30a and 30b are respectively fixed to frames A and B and are mounted for transverse adjustable movement with said frames A and B. The respective longitudinal base members 10a have suitable bottom guides 31a, 31b, 37a and 37b on which the magazines 30a and 30b slide, see FIG. 1. The magazine 30a includes a lower hollow frame member 32a and an upper hollow frame member 33a. The magazine 30a is rigidly connected to the upright frame member 15a of adjustable sliding frame structure A, as by a lower bracket member 34a and an upper bracket member 35a. The inner ends of the hollow frame members 32a and 33a are rigidly connected by a feeder guide plate 36a which forms a rigid part of the sliding frame structure A. An upper guide 38a is fixed to the fixed column member 13a, as best shown in FIG. 1, and combines with guides 31a and 37a to provide sliding support for magazine 30a on the fixed frame structure. The magazine 30b is similar to magazine 30a, just described, and includes lower hollow frame member 32b and upper hollow frame member 33b positively connected to the upright frame member 15b of frame B as by brackets 34b and 35b. A feeder guide plate 36b connects the inner ends of the hollow frame members 32b and 33b and suitable guides 31b, 37b and 38b provide the sliding support for the magazine 30b which is a fixed part of adjustable sliding frame structure B.

The magazine 30a includes an upright push bar 50a which has its lower end slideably mounted on the lower hollow frame member 32a and its upper end slideably mounted on upper hollow frame member 33a. Conveyor chains 51a and 52a are respectively housed within the hollow members 32a and 33a and are driven by a common drive shaft 53a and best shown in FIG. 1. The chain 51a is connected to the lower end of a magazine push bar 50a and the chain 52a is connected to the upper end of said bar for moving the bar in and out within the magazine 30a. A rear closure panel 55a rigidly connects the two hollow frame members 32a and 33a and extends the full length of the magazine 30a to form a rigid unit. Magazine 30b embodies a similar construction to magazine 30a and includes a magazine push bar 50b with a closure panel 55b rigidly connecting the upper and lower hollow frame members 33b and 32b.

The inner end portions of the nail supply and driving assemblies 40a and 40b are mounted on plates 45 for horizontal adjustable sliding movement on suitable slides 41a and *b* mounted on respective sleeves 22a, *b* and *c*. This permits the spacing between nailing assemblies 40a and 40b to be horizontally adjusted when the spacing between frames A and B is adjusted and also to be vertically adjusted when the elevation adjusting mechanism for sleeves 22a, *b* and *c* and sleeves 39a is actuated.

The mounting plates 21a, *b* and *c* for the stringer conveyor assemblies 20a, *b* and *c* are respectively connected to the sleeves 22a, *b* and *c* to form rigid units therewith; see FIG. 2. Cross bars 17 extend between the respective pairs of sleeves 22a, *b* and *c* to permit the stringers 60 to be removed one at a time from the bottom of the supply stacks on each of the conveyors.

Figure 11:
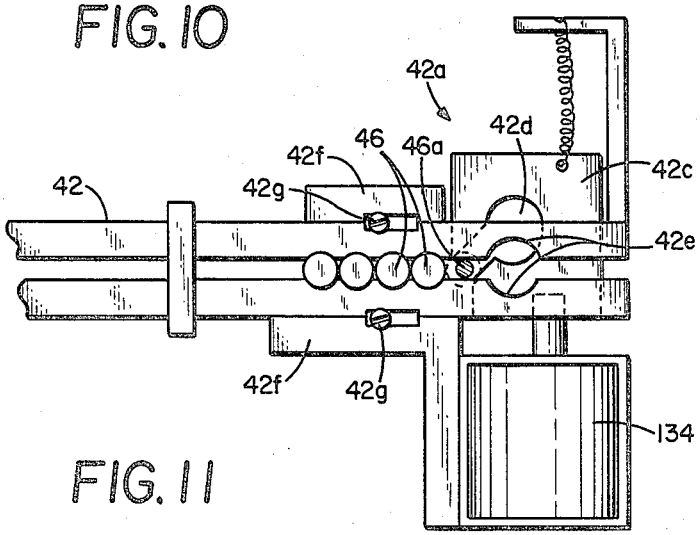
FIG. 11 is a top plan view of a typical nail dispensing solenoid mechanism.

As best shown in FIGS. 6 through 9, the nailing mechanisms 40a and 40b each includes a hopper 41, similar to the hopper feeding mechanism shown in U.S. Pat. No. 3,945,549, which delivers the nails to an inclined chute 42 which delivers the nails 46 through a one at a time dispensing mechanism 42a, shown in FIG. 11, and controllably actuated by solenoid 134. A nail dispensing slide member 42c is connected with the plunger of solenoid 134 and has a keyhole shaped dispensing opening 42d formed therein with an open mouth portion at the upper end. The rails of the chute 42 have opposed nail dispensing recesses 42e formed therein. The slide member 42c is slideably mounted for movement transversely of the chute 42. The rails of chute 42 have slideways cut therethrough below the top surface of the rails to provide transverse guideways for the slide 42c. The narrow lead-in portion of the keyhole slot 42d engages the shank of the nail 46a being held in the open mouth portion of the slot and cams the nail forwardly into the enlarged portion of the slot 42d which dispenses the nail when said slot is in registration with the opposed recesses 42e formed in the rails. When the edge surface of the slide 42c adjacent to the open mouth of the slot 42d passes across the trackway of the chute 42 the next nail is blocked from moving into the mouth of the slot until the solenoid 134 is deenergized and the return spring retracts the slide back into normal position. Mounting plates 42f are fixed to the rails of chute 42 as by being welded thereto and carry the entire dispensing mechanism 42a. Screws 42g connect the plates 42f to the lower chute 42h fixed to head mounting guide block 43d. Elongated slots in plates 42f permit the upper end of the chute 42 to be adjusted with respect to hopper 41.

A nail driving passage 43a is formed in a rod guiding head 43b which has a nail driving rod 43c slideably mounted therein and is slideably mounted in guide block 43d fixed to nailer mounting plate 45. The nails dispensed through mechanism 42a drop through the lower chute 42h which is aligned with an opening 43f in nailing head 43b which is aligned therewith when the head 43b is in retracted position. A piston rod 44 is actuated by a conventional hydraulic cylinder C. A pair of connecting rods 44a are fixed at their outer ends to piston rod 44 as by a carrier block 44b. The rods 44a are inserted into suitable chambers formed in the guiding head 43b. A spring seating disc 44c is fixed on the forward or inner end of each of the rods 44*a* and a spring cushion mounting for the guiding head 43*b* is provided by a pair of springs 44*d* and 44*e* mounted on each side of disc 44*c* and confined within each of the chambers formed in the guiding head 43*b*. A retaining plate 43*f* is secured to the outer or rear end of the head 43*b* and confines the spring assemblies 44*d* and 44*e* within the rod guiding head 43*b* but permits the connecting rods 44*a* as well as nail driving rod 43*c* to slide back and forth therethrough. When the cylinder C is actuated, a nail driving rod 43*c* and the connecting rods 44*a* are moved inwardly or forwardly. The connecting rods 44*a* and the forward springs 44*e* transmit forward motion to the head 43*b* to engage the deck boards which has been delivered to the nailing station S. When the head contacts the deck board, it seats the same in nailing position against the stringers and the inner or forward springs 44*e* are slightly compressed to securely hold the engaged deck board in nailing position. As the piston rod 44 continues to move forwardly, the inner springs are further compressed and the nail driving rod 43*c* will be moved inwardly in its passage 43*a* and ultimately drive the nail 46*b* positioned in its passage 43*a*, through the deck board into the stringer. The piston rod 44 is adjustable longitudinally in its mounting in carrier block 44*b* to cause the nail to be slightly countersunk. When the nail has been driven, the hydraulic cylinder is activated in the reverse direction and the guiding head 43*b* and rod 43*c* are retracted into the position shown in FIG. 7. A stop 44*g* is provided to engage the retaining plate 44*f* and positively position the guiding head 43*b* to align the slots 43*e* and 43*f* and limit movement of the head assembly. In the form of the invention illustrated, all six nailing assemblies 43 will be simultaneously actuated to nail each deck board in nailing position to all three of the stringers.

GENERAL STATEMENT OF OPERATION

The stringer boards are generally designated by the numeral 60 and respectively identified from top to bottom by characters 60*a, b* and *c*. The deck boards or slats are generally designated by the numeral 61 and specifically 61*a* refers to the top board and 61*b* to the bottom board. The stringer boards are fed into a nailing station S defined between the opposed nailing mechanisms 40*a* and 40*b*. This stringer feeding operation is accomplished by the chains 24*a* 24*b* and 24*c*. The forward ends of the stringers 60 are in vertical alignment at said nailing station. The first deck boards 61*a* and 61*b* are fed into the nailing station on opposite sides of the stringers 60 with the edges thereof substantially flush with the leading ends of the stringers 60. This is accomplished by a pair of feeder plates 56*a* and 56*b* slideably mounted adjacent to the stationary guide plates 36*a* and 36*b*. A suitable rack and pinion driving mechanism which includes the racks 57*a* fixed at the top and bottom of the feeder plate 56*a* and racks 57*b* fixed at the top and bottom of feeder plate 56*b*. A pair of pinions 58*a* are respectively fixed to the top and bottom of a shaft 59*a* and provide the driving connection between the shaft 59*a* and racks 57*a*. A shaft 59*b* drives pinions 58*b* and racks 57*b* to move board feeder plate 56*b* into and back from the nailing station S. These two feeder plates 56*a* and 56*b* respectively engage the inner most slats 61*a* and 61*b* from the vertical stacks in magazines 30*a* and 30*b* and feed the slats into nailing position on opposite sides of the flush ends of the horizontally disposed stringers 60. When the boards 61 are in nailing position, the nailing heads 43*b* move forward and securely hold the boards against the stringers during the driving of the nails.

After completion of the driving of the first nail into each intersection between the deck boards and the stringers at the nailing station, the stringers are advanced to the location where successive nails are to be driven into the same deck board. The stringers are then advanced to the next nailing position where two more deck boards may be fed into nailing position on opposite sides of the stringers as described above. It should be noted that each nailing head could be provided with two or three nail driving units (not shown) so that each intersection would simultaneously receive the desired number of nails. It should also be pointed out that additional nailing mechanisms (not shown) could be provided and positioned to simultaneously nail all of the deck boards to the stringers after all of the deck boards have been located in nailing position by appropriate feeding mechanisms (not shown).

A manual adjustment is provided to accomodate varying width stringer boards 60. This is provided by adjusting screws 16*a* journalled for rotation on a fixed center mounting member (not shown) and having oppositely threaded end portions which are threadably connected to a pair of opposed mounting struts 16*b* to which stringer guiding rails 16*c* are fixed. The threads for the screws 16*a* and mounting elements 16*b* on opposite sides of the stringer are pitched in opposite directions so that rotation of the oppositely threaded shafts 16*a* will move the struts 16*b* inwardly and outwardly symmetrically about the center lines of the respective stringer conveyors 20*a, b,* and *c*. This insures symmetrical alignment of the stringers 60 with their conveyors.

Figures 3, 4, 5:
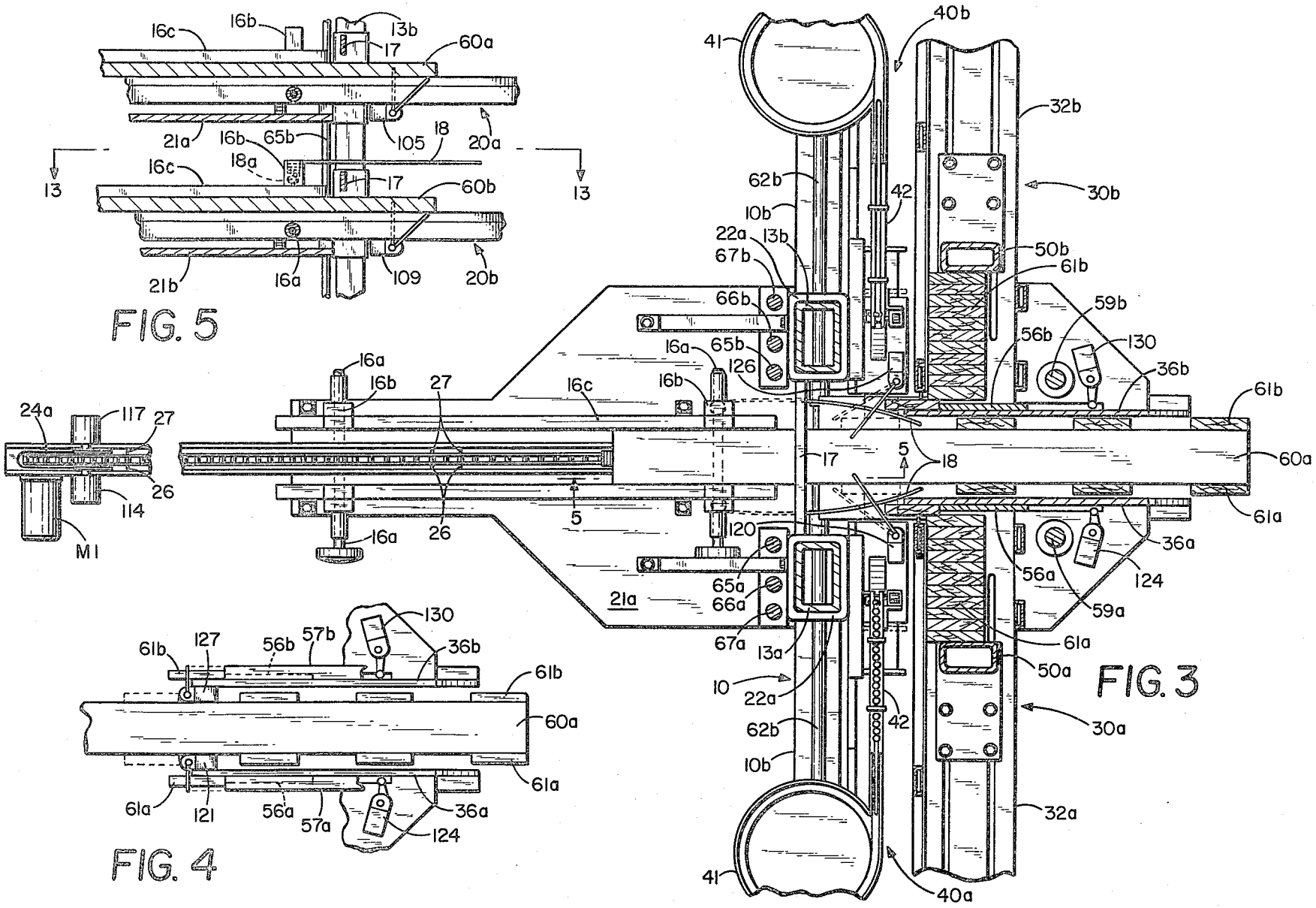
FIG. 3 is a horizontal sectional view taken substantially along the line 3—3 FIG. 2.
FIG. 4 is a fragmentary top plan view showing the relationship of the deck board feeder plate limit switches.
FIG. 5 is a fragmentary vertical sectional view taken substantially along the line 5—5 of FIG. 3 showing the position of the limit switches for sensing the presence of the top and middle stringers.
Figure 6:
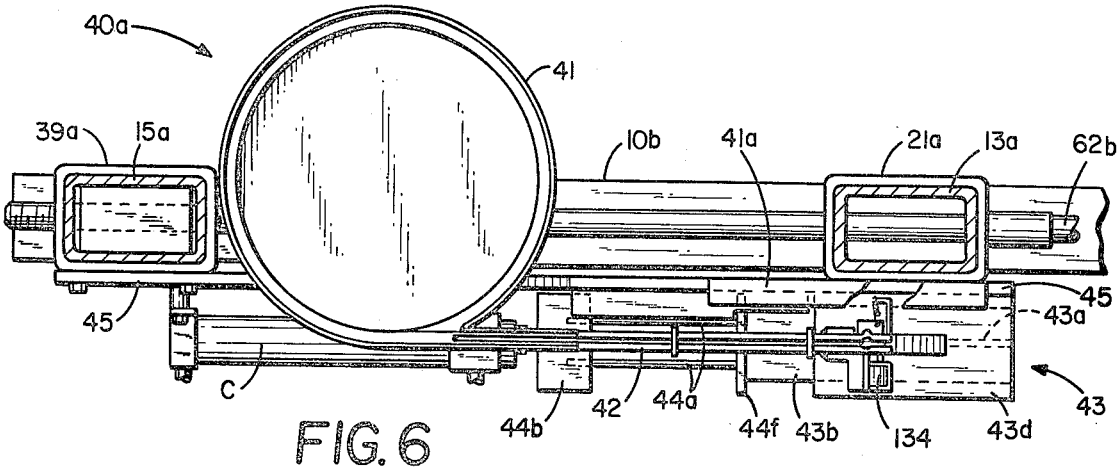
FIG. 6 is a fragmentary horizontal sectional view taken along the line 6—6 of FIG. 7.
Figure 7:
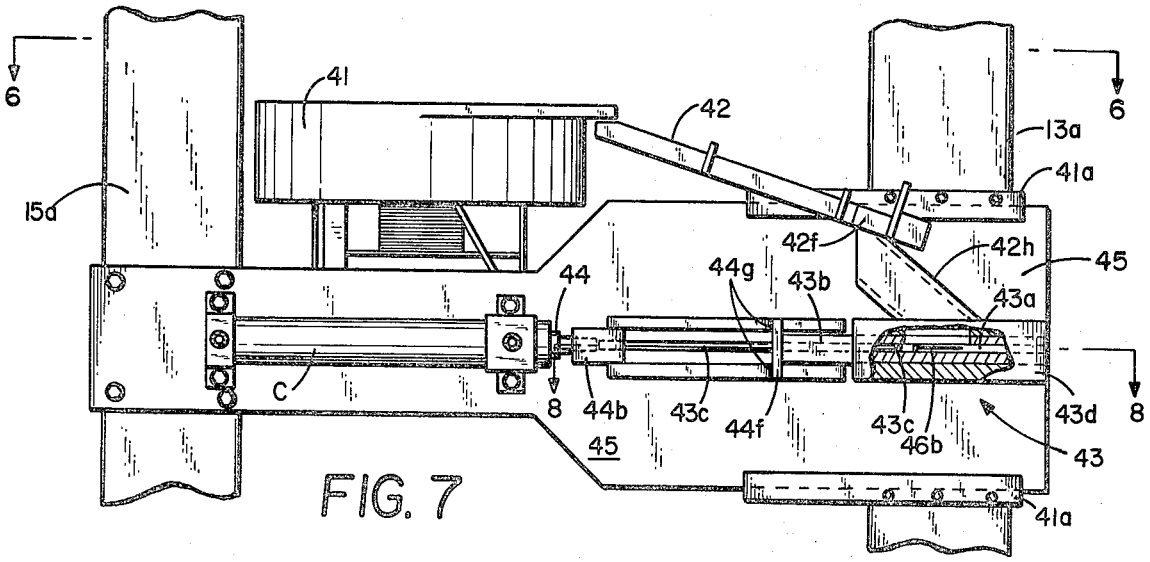
FIG. 7 is a fragmentary front elevational view showing a typical nail dispensing and driving mechanism in retracted position.
Figure 8:
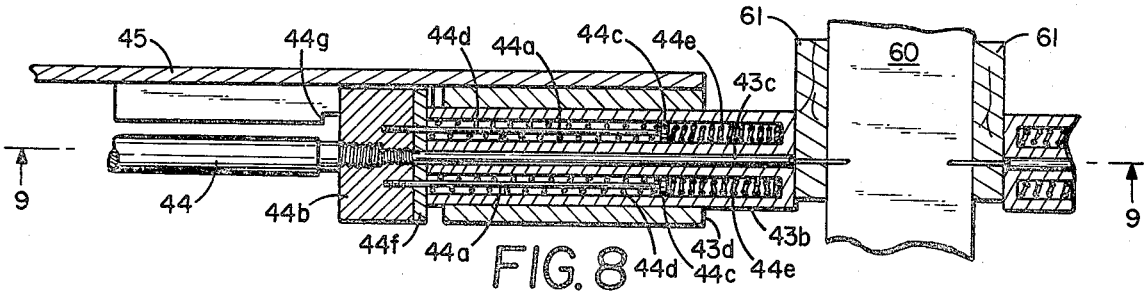
FIG. 8 is a fragmentary horizontal section showing portions of a pair of opposed nailing mechanisms in nailing position.
Figure 9:
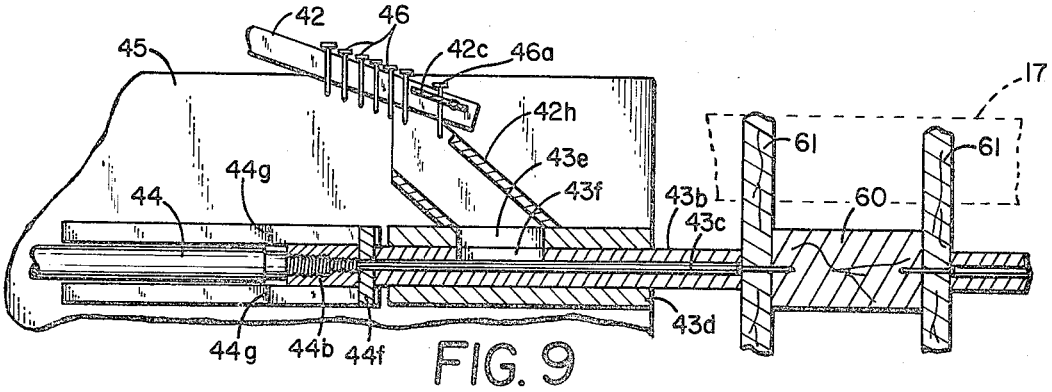
FIG. 9 is a vertical sectional view taken substantially along the line 9—9 of FIG. 8.

A pair of spring arms 18 having attachment ears 18*a*, are mounted on the upper portions of the struts 16*b* and extend rearwardly therefrom, as best shown in FIGS. 3 and 13 to stabilize and hold the slats against the ends of the nailing heads 43 during the slat feeding operation.

DESCRIPTION OF HYDRAULIC ACTUATING MECHANISMS

The power for actuating the various mechanisms of the embodiment of the invention disclosed herein are for the most part rotary hydraulic motors. These various motors are driven by hydraulic fluid supplied from a pump and reservoir unit 70, shown in FIG. 10. The three stringer feed conveyors 20*a, b,* and *c*, are respectively driven by a rotary hydraulic motors M1, M2 and M3.

Similarly rotary hydraulic motors M4 and M5 are provided for driving the chain and sprocket drive shafts 53*a* and 53*b* which move the slats (or deck boards) 61*a* and *b* in the magazines 30*a* and 30*b* toward the feeder plates 56*a* and 56*b* respectively. Hydraulic motors M6 and M7 are respectively connected to the shafts 59*a* and 59*b* which respectively actuate the feeder plates 56*a* and 56*b* through the rack and pinion driving mechanisms 57*a* and *b* and 58*a* and *b*. The feeder plates 56*a* and 56*b* move in the opposite direction to the movement of the stringers 60 on their respective conveyors. This produces a number of advantages including minimizing the adjustment required for different width deck boards 61*a* and *b*.

The six hydraulic cylinders which actuate the guiding heads 43*b* and driving rods 43*c* of each of the nailing mechanisms 40*a* and 40*b* are also supplied from the hydraulic pump unit 70.

The two adjustable sliding frame structures A and B are moved back and forth toward and away from the nailing station S by means of the upper and lower adjustment screw shafts 62*a* and *b* which are driven by hydraulic motor M8 through shaft 63 and chain and sprocket driving mechanism 64, best shown in FIGS. 1 and 2. Nailing mounting plates 45 are slideable in the slides 41*a* and 41*b* which permit the nailing mechanisms 40*a* and *b* to move in and out with the respective frames A and B, relative to the nailing station 5 between the fixed columns 13*a* and *b*, as best shown in FIG. 2. This adjustment mechanism for frames A and B varies the spacing between the nailing heads 43*b* in accordance with the width of the stringers 60 and the thickness of the top and bottom deck boards or slats 61*a* and *b*. The slat magazines 30*a* and 30*b* are also mounted on frames A and B and are simultaneously moved back and forth with the frames A and B. The adjustment of the spacing between the guide plates 36*a* and *b* is thus simultaneously made in accordance with varying dimensions of the boards 60 and 61*a* and *b*. Also, the guide plates 36*a* and *b* are maintained in constant relative positions with respect to the opposed inner ends of the nailing heads 43*b* and nailing mechanisms 40*a* and *b* carried by mounting plates 45 which are respectively mounted in slides 41*a* and *b*. The frames A and B and everything respectively mounted thereon are maintained in symmetrical relationship to a vertical plane through the common center line of the stringers being conveyed through the nailing station S.

Conveyor mounting plates 21*a*, *b* and *c* of the conveyor units 20*a*, *b* and *c*, along with both sets of nailing mechanisms 40*a* and *b* are vertically adjustable by means of the respective screw shafts 65*a* and *b*, 66*a* and *b*, and 67*a* and *b*. The two shafts 65*a* and *b* adjust the elevation of upper mounting plate 21*a* and its conveyor 20*a* along with the two upper nailing mechanisms 40*a* and 40*b* carried by plate 21*a*. The shafts 66*a* and *b* adjust the elevation of the middle mounting plate 21*b*, its conveyor 20*b* and the two middle nailing mechanisms 40*a* and 40*b*. The outer vertical screws shafts 67*a* and *b* are threadably connected to the lower mounting plate 21*c* which carries conveyor 20*c* and the two lower nailing mechanisms 40*a* and 40*b*. The lower plate 21*c* is carried by inner sleeves 22*c* which slide on the stationary columns 13*a* and *b* and by outer sleeves 39*a* and *b* which ride on the adjustable column members 15*a* and *b* of frames A and B. The upper plate 21*a* and intermediate plate 21*b* and their assemblies are respectively carried by inner sleeves 22*c* and 22*b* (mounted on fixed columns 13*a* and *b*) and outer sleeves 39*a* and *b* (respectively mounted on adjustable columns 15*a* and *b*).

The hydraulic motors used in this embodiment of the invention are conventional reversible rotary motors such as those manufactured by the Eaton Corporation of Cleveland, Ohio. Motors M1–M5 are identified by Eaton model #101-1001-007. Motors M6–M11 by model #101-1008-007. The hydraulic cylinders C are all double acting cylinders manufactured by the Tompkins-Johnson Division of Aero-Quip Corporation of Jackson, Mich. and they are identified by model #LS-1.5×8. The hydraulic pump and reservoir unit 70 is of conventional design, and is manufactured by Continental Hydraulics of Savage, Minn.

DESCRIPTION OF THE CONTROL MECHANISM AND THE OPERATION OF THE PALLET MAKER

Figure 10:
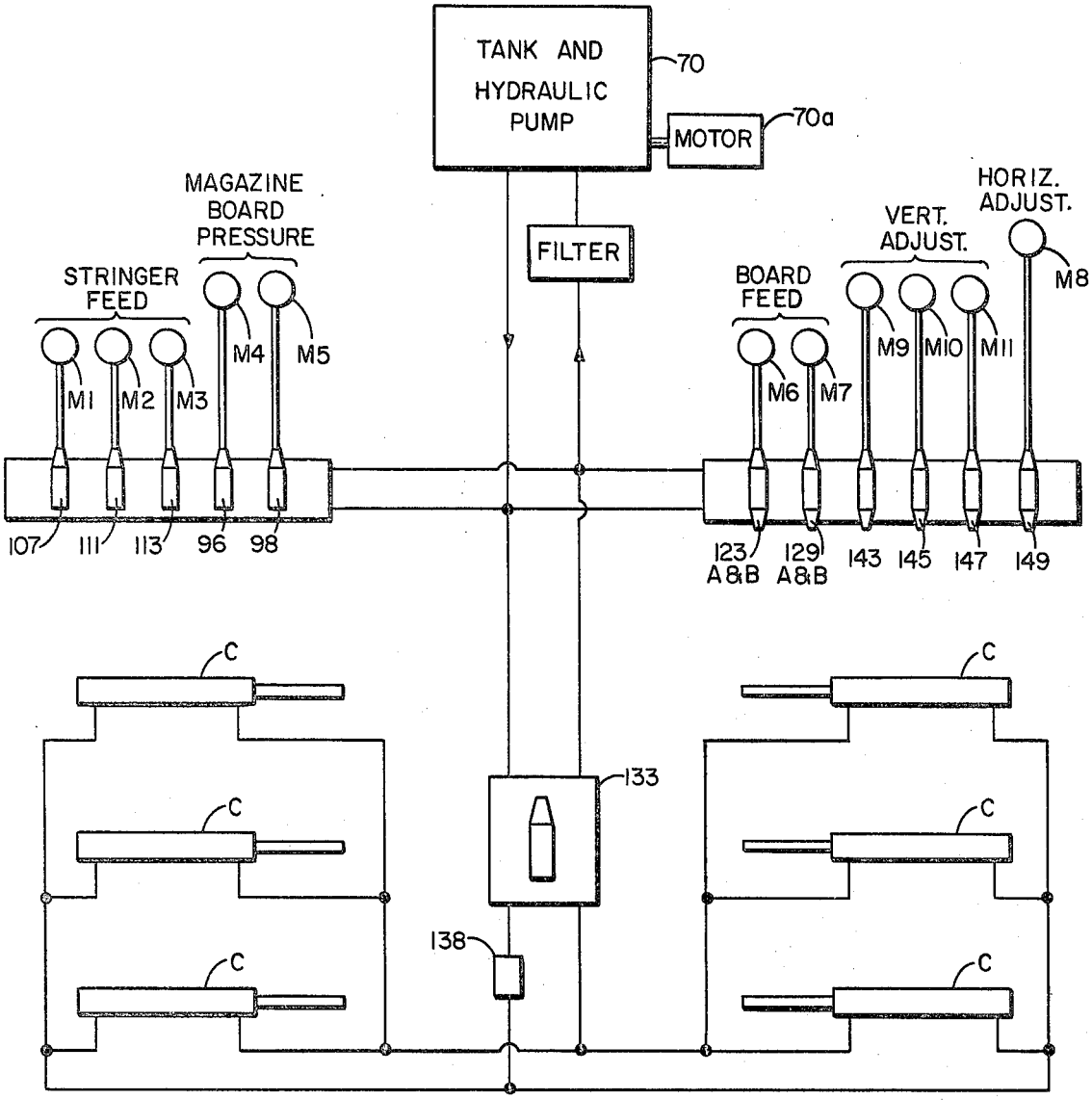
FIG. 10 is a diagrammatic view of the hydraulic system.

Hydraulic motors M1–M7 operate the mechanical operational components of the pallet maker disclosed herein and are supplied from the conventional hydraulic pump and reservoir unit 70 shown diagrammatically in FIG. 10. Solenoid valves 107, 111, 113, 123A, 123B, 129A, 129B, and 133 control the flow of hydraulic liquid to the respective hydraulic power units. Valves 107, 111 and 113 control the flow of fluid to the stringer feeding conveyor motors M1–M3. Valves 123A and 123B respectively control the forward and reverse operation of top board feeding motor M6 and valves 129A and 129B respectively control the forward and reverse operation of the bottom deck board feeding motor M7. Limit switches and control relays are provided for activating the solenoid valves and will be identified in conjunction with the following description of the control circuitry and operation thereof.

Figure 12:
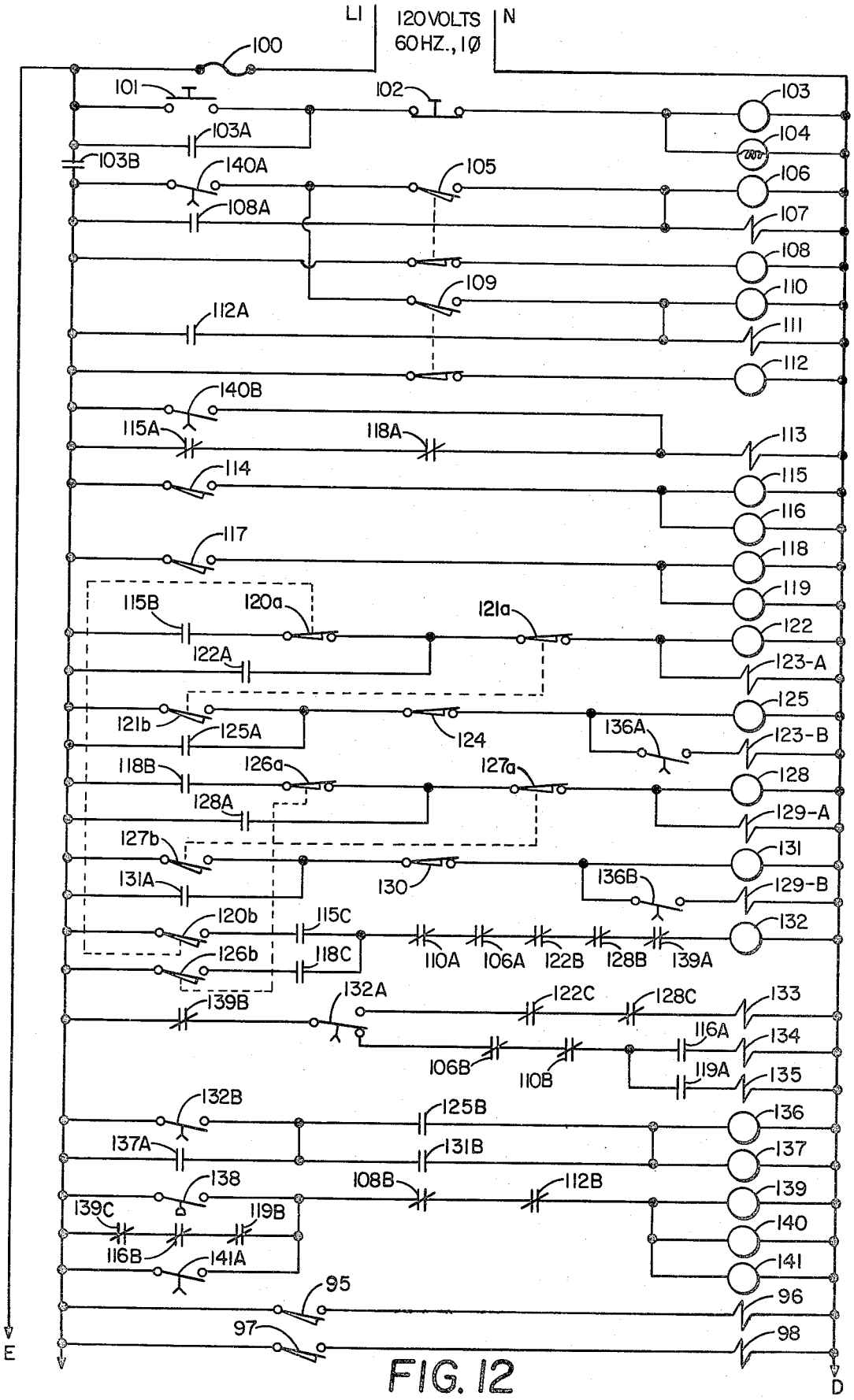
FIG. 12 is a wiring diagram showing the arrangement of the control relays and solenoids.

Referring to wiring diagram FIG. 12, with stop switch 102 closed, start button 101 is manually actuated. This energizes indicator light 104 and activates main relay 103 to close contacts to 102A and 103B. This in turn energizes solenoid valves 113 which actuates lower conveyor 20*c* and activates relays 108 and 112 which close normally open contacts 108A and 112A and activate relays 106 and 110. Closing normally open contacts 108A and 112A respectively energizes solenoid valves 107 and 111 activating the conveyors 20*a* and 20*b* to carry the top and middle stringers forwardly into their initial nailing positions at the nailing station S. The initial nailing positions of the top and middle stringers are respectively sensed by the ganged oppositely acting limit switches 105 and 109 which are positioned in the nailing station S to physically sense the presence of the top and middle stringers when they are delivered to said nailing station. These limit switches 105 and 109 remain triggered until the pallet is completed and is discharged from the machine. Solenoid valve 113 which controls bottom stringer feed motor M3 is deenergized by either limit switch 114 or 117 or both of them. Limit switch 114 activates control relay 115 which opens the normally closed contacts 115A and limit switch 117 activates relay 118 which opens normally closed contacts 118A either of which stops the lower stringer in its proper initial nailing position. The switches 114 and 117 are actuated by programming pins 26 and 27 selectively placed on opposite sides of the conveyor chain 24*c* of the lower stringer conveyor 20*c* and the position of these pins 26 and 27 control in cooperation with switches 114 and 117, the programming of the operational components of the device illustrated.

The following is a description of the sequence of operation for simultaneously feeding both top and bottom boards into nailing position:

Triggering switches 105, 109, 114 and 117 will activate relays 115, 116, 118 and 119 and contacts 115A, 118A 116B, 119B will be opened and contacts 115B and C, 118B and C, 116A and 119A will close. Both solenoid valves 123A and 129A will be energized and relays 122 and 128 are activated, opening contacts 122B and C and 128B and C and closing 122A and 128A. When valves 123A and 129A are energized, the board feeder plates 56*a* and 56*b* will engage the end boards 61*a* and *b* from the stacks in magazines 30*a* and 30*b* to simultaneously feed the two boards into their nailing positions on opposite sides of the stringers 60 at said nailing station S. Valves 123A and 129A and relays 122 and 128 remain energized until ganged oppositely acting switches 121 and 127 respectively having contacts 121*a* and *b*, and contacts 127*a* and *b* are triggered by contact with the board feed plates 56*a* and 56*b* at the end of their feeding movement.

Ganged oppositely acting switches 120 and 126 respectively having contacts 120*a* and *b* and contacts 126*a* and *b*, are positioned to sense respectively, the presence of top and bottom deck boards 61*a* and 61*b* in their opposed nailing positions at the nailing station S. Triggering of ganged switches 121 and 127 respectively deenergizes valves 123A and 129A by opening normally closed contacts 121*a* and 127*a*. Normally open contacts 121*b* and 127*b* are simultaneously closed to respectively activate relays 125 and 131. This closes contacts 125A and B, 122B and C, 131A and B, 128B and C and opens contacts 122A and 128A.

A time delay relay 132 is provided which controls the nailing operation and is activated by the closing of normally open switch contacts 120*b* and 126*b*. Before the time delay relay 132 times out electromagnets 134 and 135 are energized to actuate the one-at-a-time nail dispensing mechanisms 42*a* for both the top and bottom nailing mechanisms 40*a* and *b*. This dispenses nails one at a time into the nail passages 43*a* ahead of the respective nail driving rods 43*c* through the slots 43*f* and 43*e* which are aligned at that time. (Relays 106 and 110 being deactivated and relays 116 and 119 being activated at this time.) When time delay relay 132 times out, relay switch 132A is actuated to open the circuit to the nail dispensing solenoids 134 and 135 and energize hydraulic solenoid valve 133 (relays 122, 128 and 139 being deenergized) to simultaneously actuate all six of the hydraulic nailing cylinders C. This moves the nailing heads 43*b* and nail driving rods 43*c* inwardly toward the deck boards 61*a* and 61*b* disposed in nailing position on opposite sides of said nailing station S and all six nails are driven simultaneously through said boards into the stringers as previously described. Also when the time delay relay 132 times out, contacts 132B are closed to activate time delay relay 136 (relay contacts 125B being closed). When relay 136 times out relay contacts 136A and 136B will be closed and solenoid valves 123B and 129 will be energized to return deck board feeder plates 56*a* and *b* to their home positions where they will respectively engage normally closed switches 124 and 130 to open the same and thus deenergize solenoid valves 123B and 129B and also deactivate relays 125 and 131 which in turn activate relays 136 and 137.

A hydraulic pressure responsive switch 138 is provided in the hydraulic line to the cylinders C and when the pressure in the hydraulic line builds to a predetermined limit, switch 138 closes to activate relay 139 to open contacts 139A and B to deactivate relay 132 and deenergize solenoid valve 133. Contacts 139C are also closed at this time. Time delay relay 140 and interval timer 141 are also activated by switch 138. Activation of a time delay recycling relay 140 closes contacts 140A and B to again energize solenoid valves 107, 111 and 113 to actuate the stringer feed conveyors motors M1, 2 and 3 and repeat the feeding and nailing cycles. A pressure drop in the hydraulic line before time delay relay 140 times out will open switch 138 to deactivate relay 140 before timing out and thus prevent a new cycle of operation from being initiated. To prevent this from happening the interval timer 141 is provided to maintain contacts 141A closed for an appropriate time interval to insure that time delay 140 times out and closes contacts 140A and B which now control all of the solenoid valves 107, 111 and 113 which actuate the stringer feed conveyors 20*a*, *b* and *c*. Thus it will be seen that relay 140 and switches 114 and/or 117 now control the incremental feeding of the stringers and partially assembled pallet through the nailing station S.

The following is a description of the sequence of operation for feeding only one (not both) of the deck board 61 into nailing position:

Since the deck board feeding mechanisms for the magazines 30*a* and 30*b* are respectively responsive to separate and individual actuation of switches 114 and 117 by the respective pins 26 and 27, it will be apparent that elimination of either of said pins for any stringer location will prevent actuation of one of the switches 114 or 117. For example if pin 27 is eliminated from a particular stringer location and only pin 26 is provided at that location, only switch 114 will be triggered and only a top deck board 61 will be fed into nailing position and nailed to the stringers at that specific stringer position. By triggering only switch 114 only relays 115 and 116 will be activated. This will produce the feeding and nailing cycle for one of the top boards 61*a* as described in the operation sequence preceeding. Since switch 117 will not be triggered, relays 118 and 119 will not be activated and thus relay 128 and electro magnet 135 will not be activated. It should be pointed out that all of the hydraulic cylinders C are activated by solenoid valve 133 which is energized by activation of relay 115 which in turn activates relay 132 when switch contacts 120*b* are closed. By actuating all of the hydraulic cylinders C whenever only one of the deck boards is being fed and nailed, it will be apparent that the nailing heads on the opposite side from the nailing operation of the deck board being nailed will be respectively aligned in backup position to the nailing heads performing the nailing operation.

Pressure bars 50*a* and 50*b* are driven by hydraulic motors M4 and M5 which are actuated by manual switches 95 and 97 which respectively energize solenoid valves 96 and 98 as best shown in FIGS. 10 and 12. These push bars 50*a* and 50*b* maintain the necessary pressure on the respective stacks of deck boards in the magazines 30*a* and 30*b*.

What is claimed is:

1. An automatic board nailing machine comprising, storage means for storing in stacked relation a plurality of inner boards, automatically actuated conveyors conveying the inner boards longitudinally in a first direction along one of the longitudinal edges of the inner boards directly into nailing position from said storage means, magazines for storing outer boards in stacked relation, automatically actuated feeding means feeding in a second direction at right angles to the first direction outer boards in upright position on one of the ends of the outer boards from said magazines into nailing position on opposite sides of said inner boards to produce an assembly for nailing, automatically actuated opposed nailing means on opposite sides of said assembly for simultaneously nailing the outer boards fed into nailing position, and means for discharging the nailed-together assembly from the nailing position in the first direction.

2. The structure set forth in claim 1 wherein said nailing means includes, a plurality of opposed pairs of spaced apart nail-driving heads defining a nailing station therebetween, the inner board conveyors being constructed and arranged to simultaneously deliver a plurality of spaced apart parallel inner boards to said nailing station, said outer board feeding means being constructed and arranged to permit simultaneous feeding of said outer boards into nailing position at said nailing station on both sides of said inner boards and between the opposed pairs of said nail-driving heads, and said nailing means including means for automatically feeding nails and driving the nails through the outer boards into the inner boards at said station.

3. The structure set forth in claim 2 wherein the means for automatically feeding the outer boards comprise;

at least a pair of stack conveyor units on opposite sides of said station and progressively moving a stack of outer boards in upstanding position toward a delivery position, board feeding elements respectively engaging the end boards in said stacks to deliver said engaged outer boards into nailing position on opposite sides of said inner boards, and means for actuating said feeding means in response to the positioning of portions of the inner boards.

4. The structure set forth in claim 2 and the space between opposed nail driving heads be readily adjustable to accommodate boards of varying sizes.

5. The structure set forth in claim 2 and said inner board feeding means including an intermittent driving mechanism to progressively feed said inner boards through said nailing station, outer board feeding means including control means synchronized with said intermittent driving mechanism for feeding outer boards into said nailing station whenever said inner boards are presented in nailing position at said nailing station.

6. The structure set forth in claim 1 wherein said conveyors include guiding means for holding the inner boards in horizontal vertically spaced-apart relation, and wherein said outer board feeding means include means for holding the outer boards in unstanding nailing position during the nailing operation.

7. The structure set forth in claim 6 wherein said opposed nailing means include horizontally spaced-apart nailing heads respectively disposed in substantially horizontal alignment with the inner boards on said conveyors, said opposed nailing heads defining a nailing station therebetween, and the automatically actuated conveyors being intermittently driven to intermittently move the inner boards through said nailing station but progressively presenting said inner boards in a number of nailing positions at said nailing station to receive outer boards in each nailing position from said feeding means prior to actuation of said nailing means.

8. The structure set forth in claim 1 and said inner board conveyors being adjustable for different sized inner boards.

9. The structure set forth in claim 1 and said inner board conveyors being adjustable to accommodate inner boards of varying length and width.

10. The structure set forth in claim 1 and means for adjusting the spacing between the inner boards as they are conveyed to said nailing position.

11. The structure set forth in claim 1 and means for holding the outer boards against said nailing means during a portion of the feeding operation until completion of the nailing operation.

12. The structure set forth in claim 11 and said holding means comprising at least one pair of elongated spring elements positioned to engage the outer boards during the complete feeding operation and stabilize said boards until completion of the nailing operation.

13. A board nailing machine comprising, automatically actuated conveyors conveying inner boards into nailing position, automatically actuated feeding means feeding outer boards into nailing position on opposite sides of said inner boards to produce an assembly for nailing, automatically actuated opposed nailing means on opposite sides of said assembly for simultaneously nailing the outer boards fed into nailing position, said nailing means includes, a plurality of opposed pairs of spaced apart nail-driving heads defining a nailing station therebetween, the inner board conveyors being constructed and arranged to simultaneously deliver a plurality of spaced apart inner boards to said nailing station, said outer board feeding means being constructed and arranged to permit simultaneous feeding of said outer boards into nailing position at said nailing station on both sides of said inner boards and between the opposed pairs of said nail-driving heads, and said nailing means including means for automatically feeding nails and driving the nails through the outer boards into the inner boards at said station, a base structure, a pair of sliding frame structures mounted on opposite sides of said nailing station for adjustable sliding movement on said base structure toward and away from said nailing station and defining a centerline through the nailing station and the inner boards being conveyed, said outer board feeding means including a pair of board feeding units and said pairs of nailing heads being respectively mounted on said frame structures for adjustable simultaneous movement with said outer board feeding units, and adjustment means for moving said frame structures back and forth in accordance with variations in the dimensions of the boards being nailed to maintain said centerline coincident with center line of the inner boards conveyed to said nailing station.

14. A pallet maker comprising, storage means for storing a supply of stringer boards, a plurality of stringer conveyors for delivering stringers from said storage means longitudinally in a first direction along one of the longitudinal edges of the inner boards to a nailing station and said conveyors being arranged in generally horizontal vertically spaced apart relation with the center lines of the stringers being conveyed lying in a common substantially vertical plane, a plurality of vertically spaced apart and horizontally spaced apart opposed pairs of nailing head assemblies symmetrically spaced apart on opposite sides of the stringer center line plane and defining the nailing station between said opposed pairs of head assemblies, storage means for storing a supply of deck boards, means for automatically feeding directly from said storage means in a second direction at right angles to said first direction the deck boards in upright position on one of the ends thereof into vertical nailing position at said nailing station on opposite sides of said stringers, programmable means for controlling the number and the positions of the deck boards fed into the respective nailing positions on both sides of said stringers, means responsive to the feeding of the deck boards into their nailing positions for actuating the nailing head assemblies to nail the deck boards to the stringers to produce a nailed-together assembly, and means for discharging the nailed-together assembly from the nailing position in the first direction.

15. The structure set forth in claim 14 and said deck board feeding means including a pair of deck board supply magazines for holding a plurality of deck boards in vertical side-by-side relation positioned on opposite sides of said nailing station, and a pair of board engaging feeding elements for respectively removing the boards one at a time from said magazines and delivering said boards into nailing position at said nailing station.

16. The structure set forth in claim 15 and said feeding elements and said magazines being mounted forwardly of the nailing heads and an actuating mechanism for each of said feeding elements controlled by said programmable means for engaging the end boards in the respective magazines to remove the boards rearwardly from the magazines into the nailing station, said feeding movement being substantially parallel to the stringer center line plane and in the opposite direction to the movement of the stringer through said nailing station.

17. The structure set forth in claim 16 and said nailing head assemblies each including a fixed mounting block with a guiding head slideably mounted therein and containing a nailing passage a nail driving rod slideably mounted in said passage means for delivering nails one at a time to said passage ahead of said driving rod when the driving rod is in retracted position, and power actuating means connected to said rod and having a yieldable driving connection with said guiding head to initially project the head into engagement with a deck board positioned in said nailing station and thereafter permit the nailing rod to be projected therethrough to drive the nail in said passage into the deck board and stringers.

18. The structure set forth in claim 14 wherein said stringer conveyors are provided with adjusting means for accommodating stringers of varying widths.

19. The structure set forth in claim 14 and means disposed above of each of said stringer conveyors for holding a supply of stringers and, means for delivering the stringer boards one at a time from each conveyor supply to said nailing station for the nailing operation.

20. The structure set forth in claim 14 and means for engaging and holding the deck boards during the feeding operation and holding said deck boards against the nailing head assemblies until completion of the nailing operation.

21. The structure set forth in claim 20 and said holding means comprising spring elements for resiliently engaging said deck boards during the feeding operation and urging said boards into engagement with the nailing head assemblies until completion of the nailing operation.

22. A pallet maker comprising, a programmable control mechanism, automatically controlled stringer conveyors actuated in accordance with said control mechanism, automatically actuated deck board feeding means for feeding the deck boards into nailing position on opposite sides of said stringers in accordance with the control mechanism to form a stringer and deck board assembly, automatically actuated opposed nailing means on opposite sides of the stringer and deck board assembly for nailing the deck boards fed into nailing position and responsive for actuation to the feeding of deck boards into nailing position and to said control mechanism, said automatically actuated deck board feeding means including separate feed mechanisms disposed on opposite sides of the stringer conveyors, and said programmable control mechanism including separate control means for separately actuating the two deck board feeding mechanisms whereby different relative positions between the deck boards on opposite sides of said stringers can be obtained.

23. The structure set forth in claim 22 and said programmable control mechanism including automatically actuated sensing means for sensing increments of travel of said stringer conveyors to successively present portions of the stringers to receive deck boards at the nailing position.

24. The structure set forth in claim 22 wherein said nailing means includes controllable nail dispensing means for supplying nails to said nailing means, and means for disabling the said dispensing means for one side of said stringers at a selected nailing position whenever the deck board is not fed into nailing position at that location.

25. The method for automatically nailing a plurality of boards together comprising, automatically conveying in a first direction a plurality of inner boards longitudinally on one of their longitudinal edges from storage means into nailing position at a nailing station, automatically feeding in a second direction at right angles to said first direction outer boards while in upright on end position from storage means into nailing position at said nailing station in opposed relationship on opposite sides of said inner boards to produce an assembly for nailing, automatically nailing the opposed outer boards to said inner boards simultaneously on both sides of said inner boards to form a nailed-together assembly, and discharging in said first direction the nailed together assembly from the nailing position.

26. The method set forth in claim 25 wherein said inner boards are conveyed to said nailing station in horizontal vertically spaced apart parallel relation, and said outer boards are fed into upstanding vertical nailing position at said nailing station on opposite sides of said inner boards.

27. The method set forth in claim 26, and providing a pair of outer board magazines on opposite sides of said nailing station, and controllably feeding outer boards from said magazines while in vertical upstanding position into nailing position at said nailing station.

28. The method set forth in claim 27, and maintaining the outer boards in said magazines in substantially vertical position to facilitate the individual feeding thereof.

29. The method set forth in claim 26, and adjusting the vertical spaced relation between the inner boards and the nailing means.

30. The method set forth in claim 25, and actuating said outer board feeding means in response to positioning of inner boards at said nailing station, and actuating said nailing means in response to positioning of said outer boards in nailing position at said nailing station.

* * * * *